US006219884B1

(12) United States Patent
Adriano

(10) Patent No.: US 6,219,884 B1
(45) Date of Patent: Apr. 24, 2001

(54) METHOD AND APPARATUS FOR DECORATIVE TOILET FLUSH HANDLES

(76) Inventor: Renwick N Adriano, 729 Onipaa Pl., Makawao, HI (US) 96768

( * ) Notice: Subject to any disclaimer, the term of this patent is extended or adjusted under 35 U.S.C. 154(b) by 0 days.

(21) Appl. No.: 09/407,050

(22) Filed: Sep. 27, 1999

(51) Int. Cl.[7] ..... E03D 5/09; E03D 1/00

(52) U.S. Cl. ..... 16/110.1; 4/405; 16/441; 16/DIG. 41; 16/DIG. 30

(58) Field of Search ..... 16/110.1, 441, 16/DIG. 41, DIG. 30; 411/508, 509, 913, 342, 344, 345; 4/405, 411, 412

(56) References Cited

U.S. PATENT DOCUMENTS

| | | | | |
|---|---|---|---|---|
| D. 252,584 | | 8/1979 | Raz . | |
| D. 318,715 | | 7/1991 | Hardman . | |
| D. 318,716 | | 7/1991 | Hardman . | |
| D. 319,297 | | 8/1991 | Hardman . | |
| D. 320,646 | | 10/1991 | Hardman . | |
| D. 389,392 | | 1/1998 | Wan . | |
| 2,364,314 | * | 12/1944 | Pleasant et al. | 4/405 X |
| 3,278,948 | * | 10/1966 | Jensen | 4/405 |
| 4,624,018 | * | 11/1986 | Kurtz | 4/405 X |
| 4,864,665 | * | 9/1989 | Toltzman | 4/405 X |
| 4,876,766 | | 10/1989 | Cohen . | |
| 5,206,960 | * | 5/1993 | Hooshley et al. | 4/325 |
| 5,666,693 | | 9/1997 | Levay . | |
| 5,771,502 | * | 6/1998 | O'Grady | 4/405 |

* cited by examiner

*Primary Examiner*—Robert Sandy
(74) *Attorney, Agent, or Firm*—Michael I. Kroll

(57) ABSTRACT

The present invention 14 discloses a method and apparatus for attaching a decorative flush handle 10 to a conventional toilet 12. Shown is a threaded shaft 16 having a first rotatable member 18 mounted thereon having a pair of oppositely opposing, hingedly mounted arms 30 spring tensioned away from each for mounting in the inner cavity 40 of the decorative item 10. A second rotatable disc 36 is threadably attached to shaft 16 and adjustable positioned on shaft 16 to fixedly secure the wall 25 of the decorative item between disc 36 and arms 30. Arms 30 have external threads 32 thereon so that the arms 30 and shaft 16 can function somewhat like a conventional screw for placement in decorative items.

12 Claims, 8 Drawing Sheets

METHOD AND APPARATUS FOR DECORATIVE TOILET FLUSH HANDLES

BACKGROUND OF THE INVENTION

1. Field of the Invention

The present invention relates generally to toilet flush handles and, more specifically, to a method and device for attaching a plurality of decorative and novel figurines. The device is comprised of a threaded shaft having two members mounted thereon. The first member has a collar with a centrally positioned threaded aperture for selectively positioning said first member on the threaded shaft. The collar has two oppositely positioned springs attached to the exterior surface of the collar having each leg member fixedly positioned to divergent arm members. The arm members have threads on their external surfaces so that the divergent arms can be pressed to the body of the threaded shaft whereby the divergent arms will permit the device to be used in much the same fashion as a screw. This will enable the fastener to be threaded into a user-supplied cavity with the chosen decorative object. Further the decorative object can be fixedly attached to the device by applying an amount of adhesive on the divergent arms prior to mounting the decorative object thereon.

In addition if the decorative item has no interior structure, such as in the case of a seashell, the device can be inserted into a user-supplied aperture whereupon the divergent arm members will flair out once inside the decorative object. The second member is a disc having a centrally positioned threaded aperture therethrough. The second mounted member can be advanced toward the first mounted member until the decorative item is fixedly contained between the two mounted members. The decorative object can be further fixedly attached by applying an amount of adhesive to the contact points between the first and second mounting members and the decorative figurine.

2. Description of the Prior Art

There are other decorative handles designed for novelty purposes. Typical of these is U.S. Pat. No. 4,876,766 issued to Cohen on Oct. 31, 1989.

Another patent was issued to Levay on Sep. 16, 1997 as U.S. Pat. No. 5,666,693. Yet another U.S. Pat. No. Des. 252,584 was issued to Raz on Aug. 7, 1979 and still yet another was issued on Jul. 30, 1991 to Hardman as U.S. Pat. No. Des. 318,715.

Another patent was issued to Hardman on Jul. 30, 1991 as U.S. Pat. No Des. 318,716. Yet another U.S. Pat. No. Des. 319,297 was issued to Hardman on Aug. 20, 1991. Another was issued to Hardman on Oct. 8, 1991 as U.S. Pat. No. Des. 320,646 and still yet another was issued on Jan. 20, 1998 to Wan as U.S. Pat. Des. 389,392.

U.S. Pat. No. 4,876,766

Inventor: Richard K. Cohen

Issued: Oct. 31, 1989

A decorative faucet handle mounting apparatus includes an adapter having a first bore complimentarily shaped to the shape of a faucet stem. A second bore formed coaxially in the adapter cooperates with a fastener to attach the adapter to the faucet stem. A decorative handle has a longitudinal bore extending inward from one end which is engageable over the adapter. A perpendicular bore formed in the handle receives a threaded fastener engageable through the perpendicular bore with the adapter to secure the handle to the adapter.

U.S. Pat. No. 5,666,693

Inventor: Peggy Levay

Issued: Sep. 16, 1997

A novelty device simulating a portion of a character or an object, such as half an animal, for example a frog, is capable of functioning as a toy handle for use with oral devices such as lollipops, popsicles, or teething rings or the like, which are typically placed in the mouth of the user and provided with a handle allowing periodic removal. The amusement device allows interactive response between the user and the toy handle, as well as between the user and observers, evoking a surprised, humorous reaction in the observer. The toy handle has securing structure disposed within a receiving channel of the main body of the toy handle such that the typical handle of such an oral device may be selectively and removably secured within the toy handle. Where the handle of the oral device is a typical wrapped paper handle for a lollipop, the securing structure may be a frustoconically shaped threaded channel such as used with a wire nut, to deform and thus secure the paper lollipop handle in the toy handle of the present invention. Alternative securing structure are also disclosed.

U.S. Pat. No. Des. 252,584

Inventor: Zeev Raz

Issued: Aug. 7, 1979

This United States Patent discloses an ornamental design for a toilet flush handle as illustrated in the drawings of the patent.

U.S. Pat. No. Des. 318,715

Inventor: Ronald P. Hardman

Issued: Jul. 30, 1991

This United States Patent discloses an ornamental design for a toilet flush handle as illustrated in the drawings of the patent.

U.S. Pat. No. Des. 318,716

Inventor: Ronald P. Hardman

Issued: Jul. 30, 1991

This United States Patent discloses an ornamental design for a toilet flush handle as illustrated in the drawings of the patent.

U.S. Pat. No. Des. 319,297

Inventor: Ronald P. Hardman

Issued: Aug. 20, 1991

This United States Patent discloses an ornamental design for a toilet flush handle as illustrated in the drawings of the patent.

U.S. Pat. No. Des. 320,646

Inventor: Ronald P. Hardman

Issued: Oct. 8, 1991

This United States Patent discloses an ornamental design for a toilet flush handle as illustrated in the drawings of the patent.

U.S. Pat. No. Des. 389,392

Inventor: Chen Wan

Issued: Jan. 20, 1998

This United States Patent discloses an ornamental design for a doorknob as illustrated in the drawings of the patent.

While these decorative handles designed for novelty purposes may be suitable for the purposes for which they were designed, they would not be as suitable for the purposes of the present invention, as hereinafter described.

SUMMARY OF THE PRESENT INVENTION

The present invention discloses a method and apparatus for attaching a decorative flush handle to a conventional toilet. Shown is a threaded shaft having a first rotatable member mounted thereon having a collar having a pair of oppositely opposing, hinged arms spring tensioned away from each for mounting in the inner cavity of the decorative item. A second rotatable disc threadably attached to the threaded shaft and adjustable positioned on the shaft in order to fixedly secure the wall of the decorative item between the disc and the arms. The arms have external threads thereon so that the arms and shaft can function somewhat like a conventional screw for placement in decorative items.

A primary object of the present invention is to provide decorative handles for toilet bowl flush handles.

Another object of the present invention is to provide a device which provides means for mounting a plurality of decorative item and figurines as toilet bowl flush handles.

Yet another object of the present invention is to provide a device having a threaded central shaft which can be mounted to the toilet bowl handle flush mechanism.

Still yet another object of the present invention is to provide a device having a threaded central shaft which can be mounted to the toilet bowl handle flush mechanism having a first and second rotative member mounted thereon.

Another object of the present invention is to provide a device having a threaded central shaft having a rotative first member having an internally threaded collar having springs fixedly attached to said collar and fixedly attached to divergent arm members.

Yet another object of the present invention is to provide a device having a threaded central shaft having a rotative first member having hingedly attached divergent arm members having exteriorly threaded surfaces which can be compressed to the central shaft and threaded into a solid core decorative item.

Still yet another object of the present invention is to provide a device having a threaded central shaft having a disc shaped rotative second member having a threaded bore therethrough.

Another object of the present invention is to provide a device having a threaded central shaft having a first rotative member having hingedly attached divergent arm members and having a disc shaped rotative second member working in conjunction with said first member whereby said first member can be inserted into a hollow decorative article and said second member can be advanced until said first and second members are frictionally in contact with the exterior wall of said decorative article.

Additional objects of the present invention will appear as the description proceeds.

The present invention overcomes the shortcomings of the prior art by providing a method and device for attaching a plurality of decorative articles and novel figurines. The device is comprised of a threaded shaft having two members mounted thereon. The first member has a collar with a centrally positioned threaded aperture for selectively positioning said first member on the threaded shaft. The collar has two oppositely positioned springs attached to the exterior surface of the collar having each leg member fixedly positioned to divergent arm members. The arm members have threads on their external surfaces so that the divergent arms can be pressed to the body of the threaded shaft whereby the divergent arms will permit the device to be used in much the same fashion as a screw. This will enable the fastener to be threaded into a selectively chosen solid core decorative article. Further the decorative object can be fixedly attached to the device by applying an amount of adhesive on the divergent arms prior to mounting the decorative object thereon.

In addition if the decorative item has no interior structure, such as in the case of a seashell, the device can be inserted into a user-supplied aperture whereupon the divergent arm members will flair out once inside the decorative article. The second mounted member is a disc having a centrally positioned threaded aperture therethrough. The second mounted member can be advanced toward the first mounted member until the decorative item is fixedly contained between the two mounted members. The decorative object can be further fixedly attached by applying an amount of adhesive to the contact points between the first and second mounting members and the decorative figurine or by injecting an expandable foam material which will provide rigidity for said hollow core decorative article.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

As illustrated the decorative item has no interior structure. The present invention mounting hardware device having a first rotative member having divergent arm members can be inserted into a user-supplied aperture whereupon the divergent arm members will flair out once inside the decorative object. The second mounted member is a disc having a centrally positioned threaded aperture therethrough. The second mounted member can be advanced toward the first mounted member until the ornamentally decorative item is fixedly contained between the two mounted members.

Figure 3:
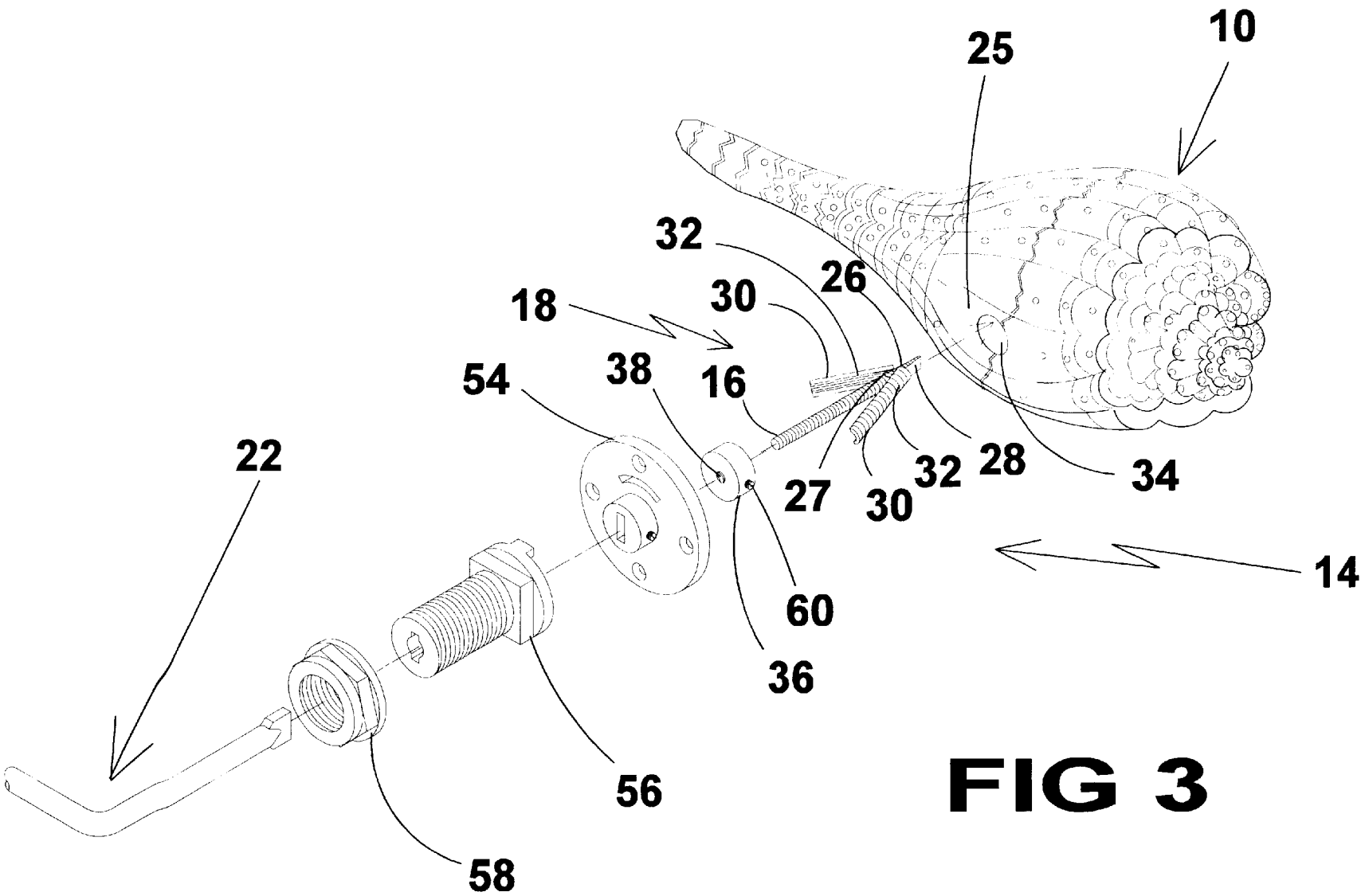
FIG. 3 is an exploded view of the ornamental toilet flush handle as shown in FIG. 2. The device is comprised of a threaded shaft having two members mounted thereon. The first member has a collar with a centrally positioned threaded aperture for selectively positioning said first member on the threaded shaft. The collar has two oppositely positioned springs attached to the exterior surface of the collar having each leg member fixedly positioned to divergent arm members. The arm members have threads on their external surfaces so that the divergent arms can be pressed to the body of the threaded shaft whereby the divergent arms will permit the device to be used in much the same fashion as a screw.
Figure 3A:
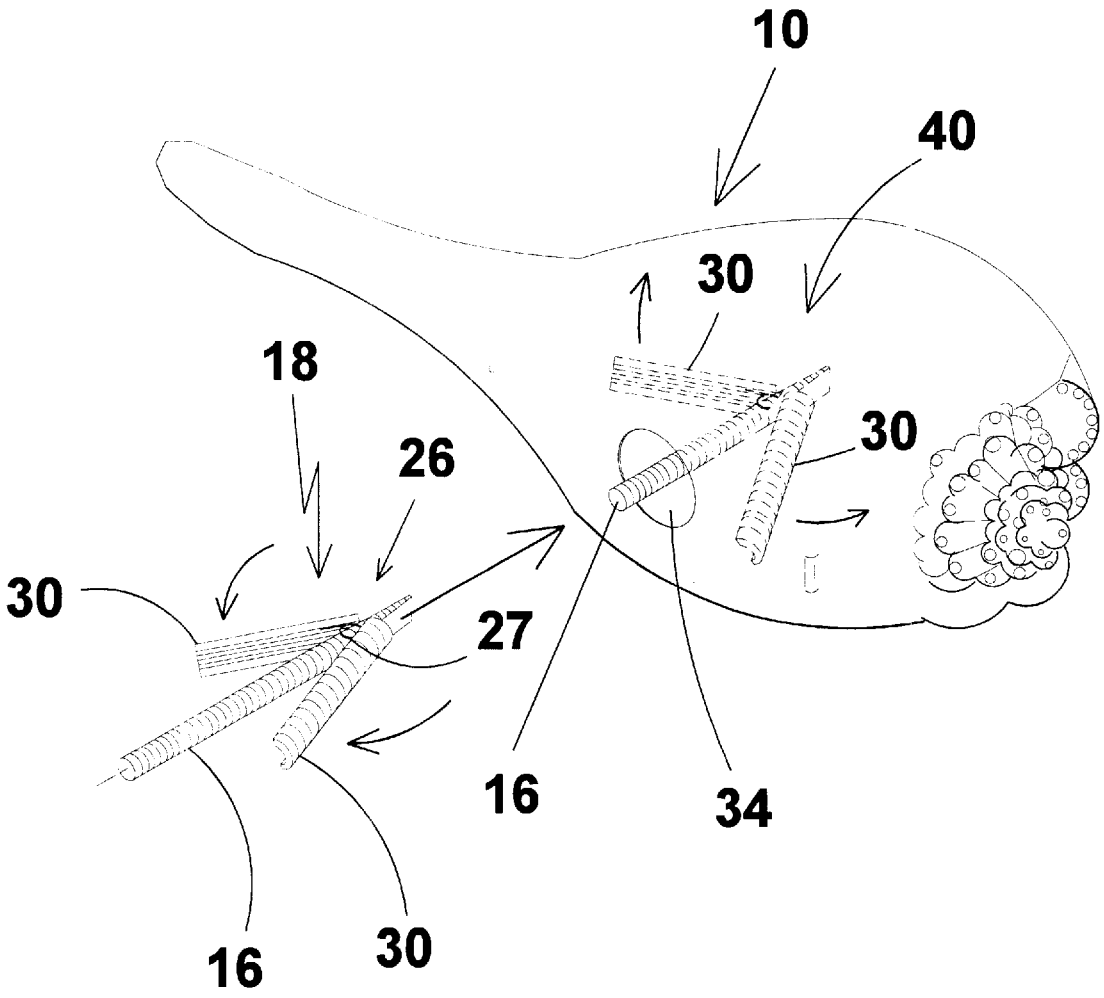

FIG. 3A is an illustrative view of the ornamental decorative article which will be used instead of the manufactures toilet flush handle having a user supplied access aperture therein. Also shown is the central shaft member having the first rotative member mounted thereon. The divergent hingedly attached arms can be compressed to insert said threadably mounted first member into the ornamentally decorative articles cavity whereby said first members divergent arms will extend to a fully open at rest position.

Figure 4:
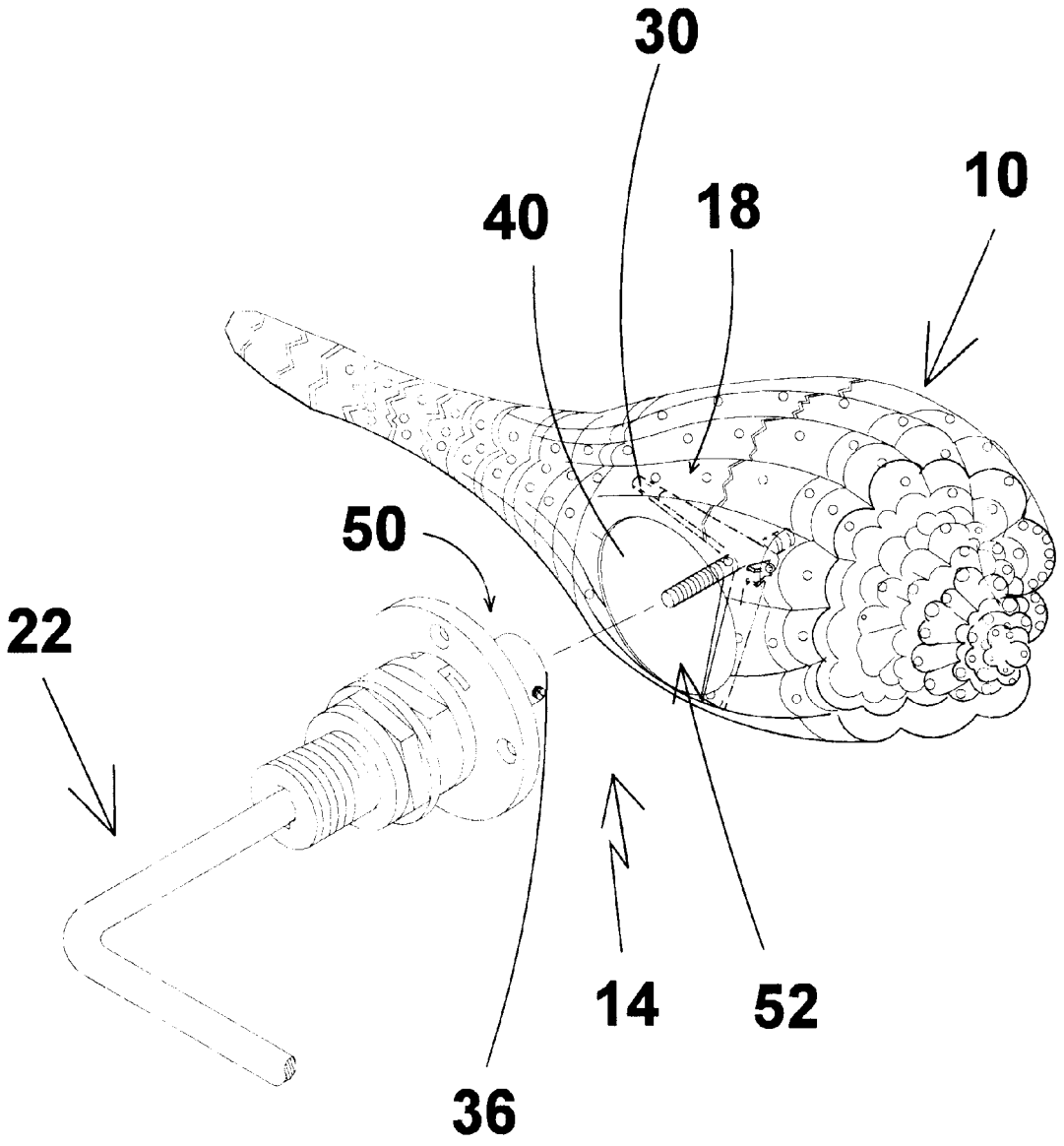

FIG. 4 is a continued illustrative view of the method and device for mounting the ornamentally decorative seashell onto the present invention mounting hardware whereby said ornamentally decorative seashell can be used in place of the manufactures supplied flush handle. Once the first rotative member having divergent arm members is positioned with the cavity of the decorative article having the arm in a fully extended at rest position. The second mounted member can be advanced toward the first mounted member until the decorative item is fixedly contained between the two mounted members. The decorative object can be further fixedly attached by applying an amount of adhesive to the contact points between the first and second mounting members and the decorative figurine or by injecting an expandable foam material which will provide rigidity for said hollow core decorative article.

Figure 5:
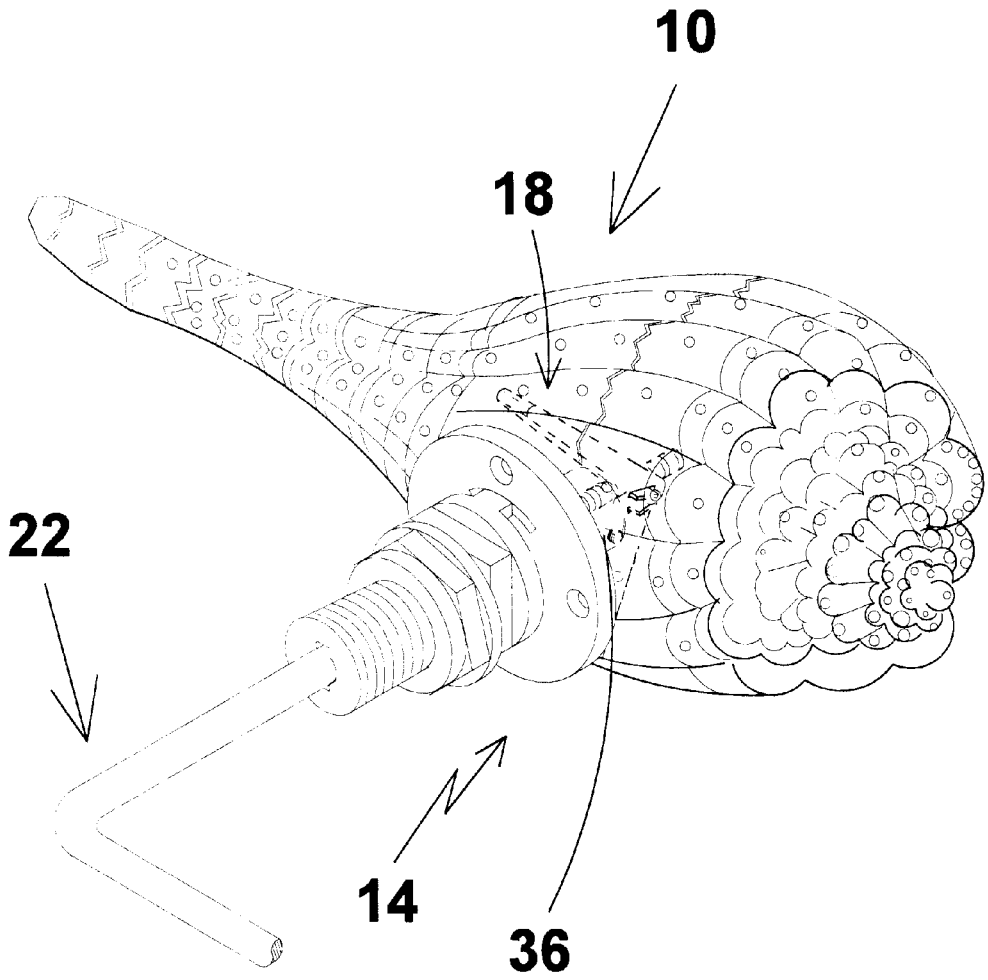

FIG. 5 is a continued illustrative view of the method and device for mounting the ornamentally decorative seashell onto the present invention mounting hardware whereby said ornamentally decorative seashell can be used in place of the manufactures supplied flush handle. Shown is the decorative handle installed in place of the manufacturer's handle. The means for securing the seashell using the threadably mounted first and second member can additionally be enhanced by the selective application of adhesive.

Figure 6:
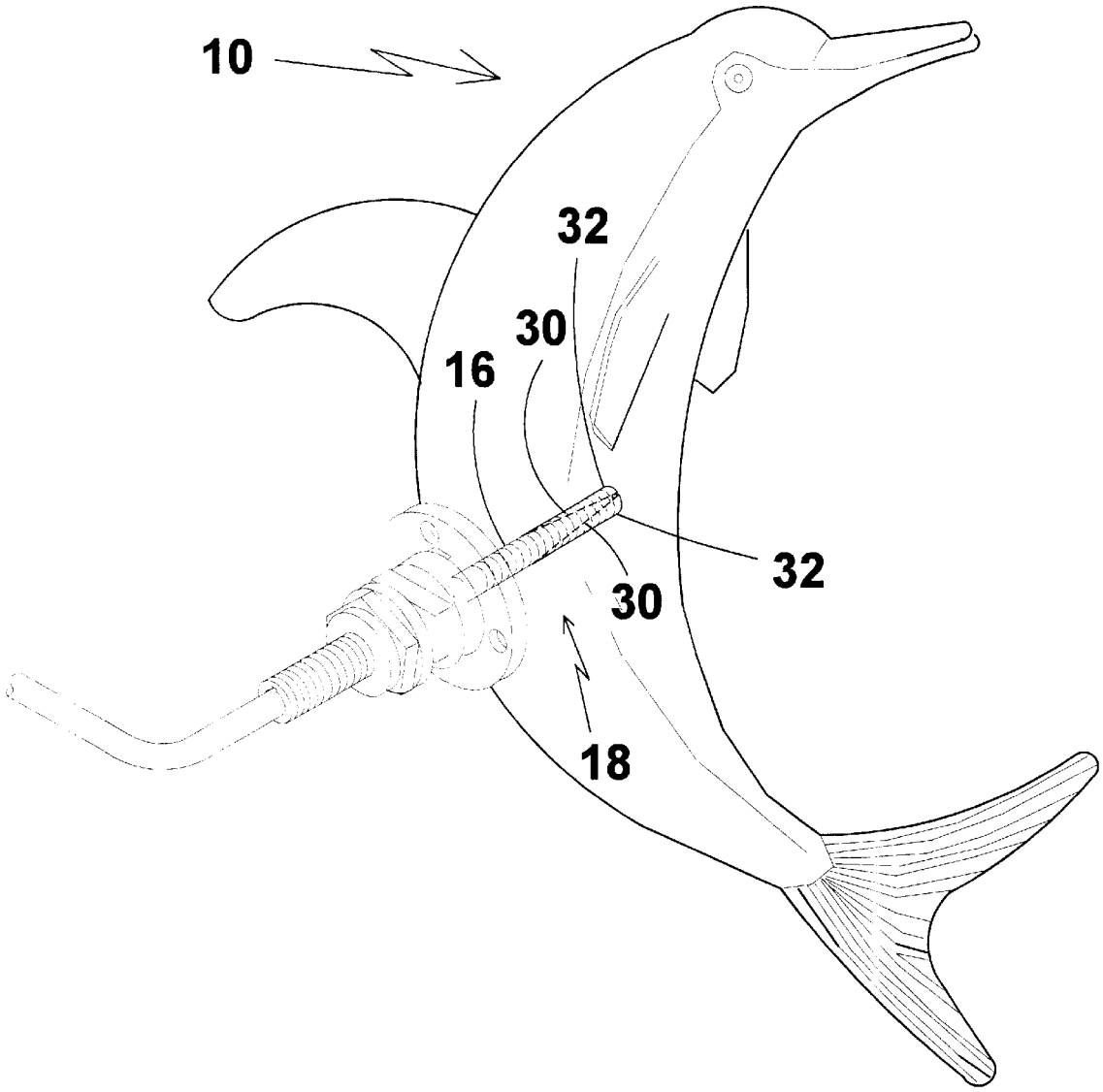

FIG. 6 is an illustration of an ornamental article affixed to the toilet as the flush handle. The mounting hardware device is comprised of a threaded shaft having two members mounted thereon. The first member has a collar with a centrally positioned threaded aperture for selectively positioning said first member on the threaded shaft. The collar has two oppositely positioned springs attached to the exterior surface of the collar having each leg member fixedly positioned to divergent arm members. The arm members have threads on their external surfaces so that the divergent arms can be pressed to the body of the threaded shaft whereby the divergent arms will permit the device to be used in much the same fashion as a screw. This will enable the fastener to be threaded into a user-supplied cavity with the chosen decorative object. Further the decorative object can be fixedly attached to the device by applying an amount of adhesive on the divergent arms prior to mounting the decorative object thereon.

Figure 7:
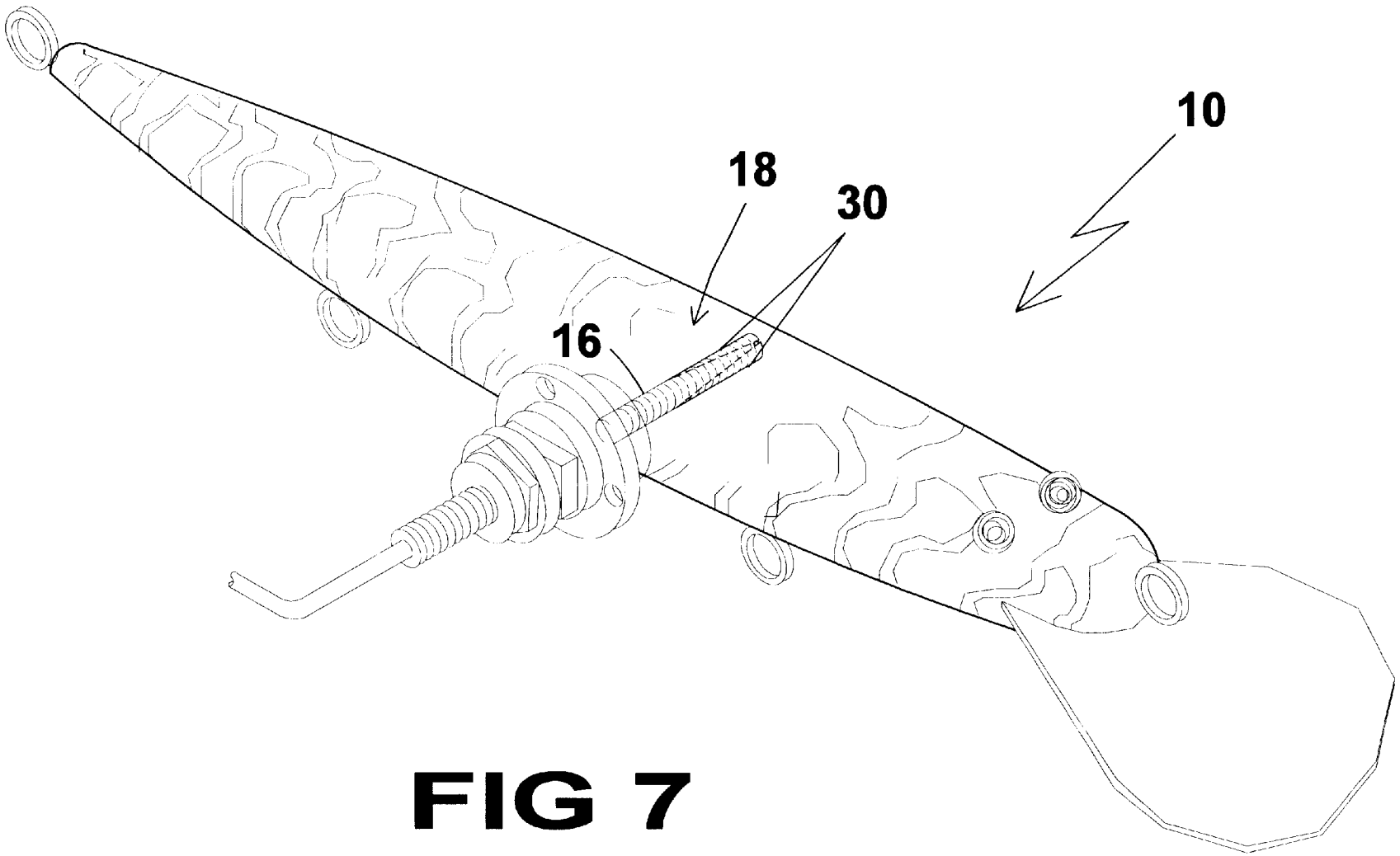

FIG. 7 is an additional illustration of an ornamental article affixed to the toilet as the flush handle. The mounting hardware is comprised of a threaded shaft having two members mounted thereon. The first member has a collar with a centrally positioned threaded aperture for selectively positioning said first member on the threaded shaft. The collar has two oppositely positioned springs attached to the exterior surface of the collar having each leg member fixedly positioned to divergent arm members. The arm members have threads on their external surfaces so that the divergent arms can be pressed to the body of the threaded shaft whereby the divergent arms will permit the device to be used in much the same fashion as a screw. This will enable the fastener to be threaded into a user-supplied cavity with the chosen decorative object. Further the decorative object can be fixedly attached to the device by applying an amount of adhesive on the divergent arms prior to mounting the decorative object thereon.

LIST OF REFERENCE NUMERALS

With regard to reference numerals used, the following numbering is used throughout the drawings:

10 decorative item
12 toilet
14 present invention
16 shalt
18 rotating members
20 toilet tank
22 lift arm
24 tank cover
25 wall of decorative item
26 collar
27 springs
28 collar threaded apertures
30 arm members
32 external threads
34 access aperture
36 disc
38 disc threaded aperture
40 cavity
50 adhesive
52 foam
54 mounting hardware
56 fastener
58 nut
60 set screw

DESCRIPTION OF THE PREFERRED EMBODIMENT(S)

In order that the invention may be more fully understood, it will now be described, by way of example, with reference to the accompanying drawings in which FIGS. 1 through 7 illustrate the present invention being an apparatus for a decorative toilet flush handle.

Figure 1:
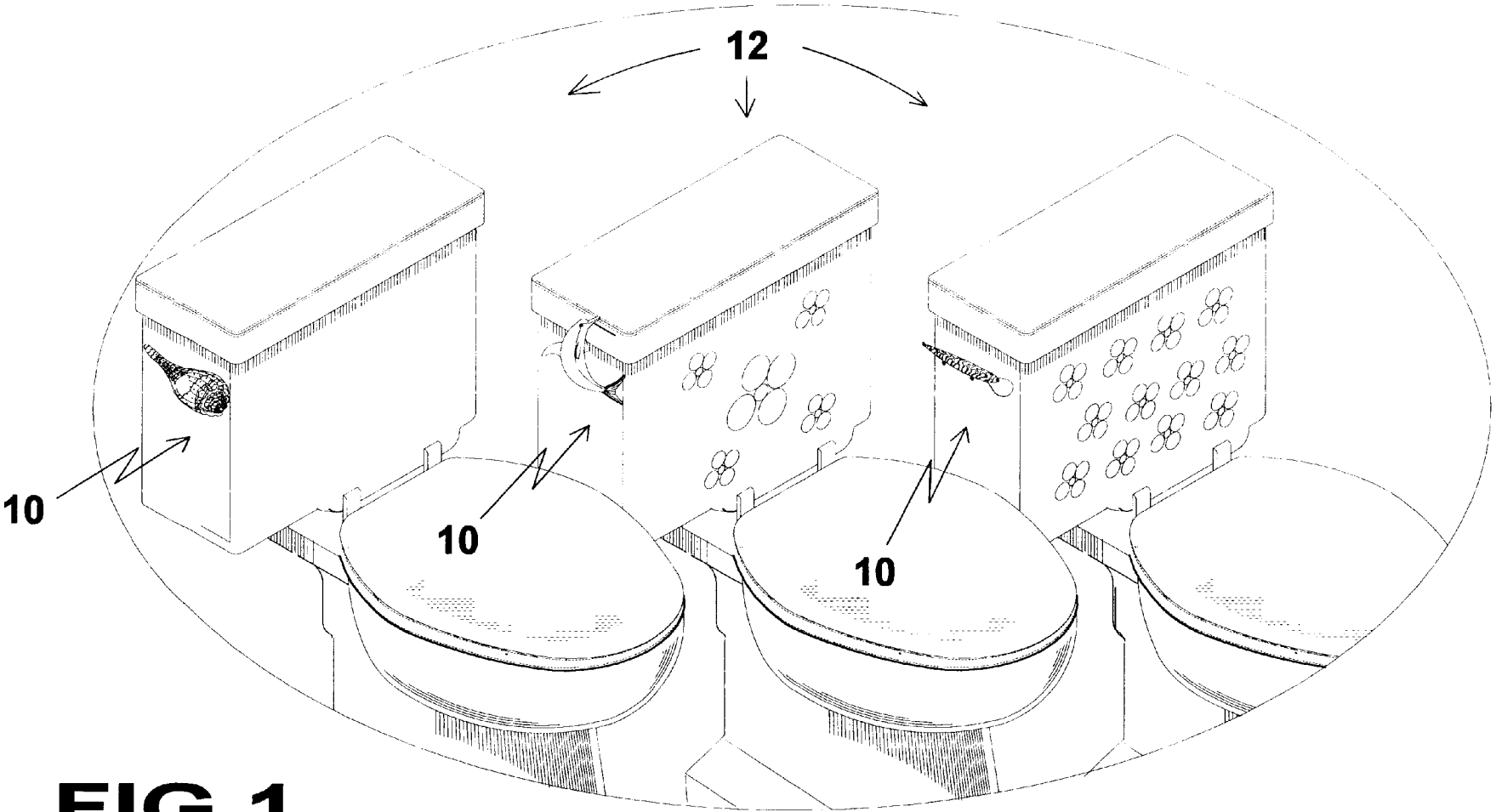
FIG. 1 an illustrative view of a plurality of different ornamental decorative items which can be used as toilet flush handles by using the mounting hardware of the present invention. Shown are examples of solid core and hollow core ornamentally decorative items which can be used functional after being mounted to the toilet bowl flush mechanism using the mounting device of the present invention.

Turning to FIG. 1, shown therein is an illustrative view of a plurality of different ornamental decorative items 10 which can be used as toilet 12 flush handles by using the mounting hardware of the present invention.

Shown are examples of solid core and hollow core ornamentally decorative items which can be used functional after being mounted to the toilet bowl 12 flush mechanism using the mounting device of the present invention.

Figure 2:
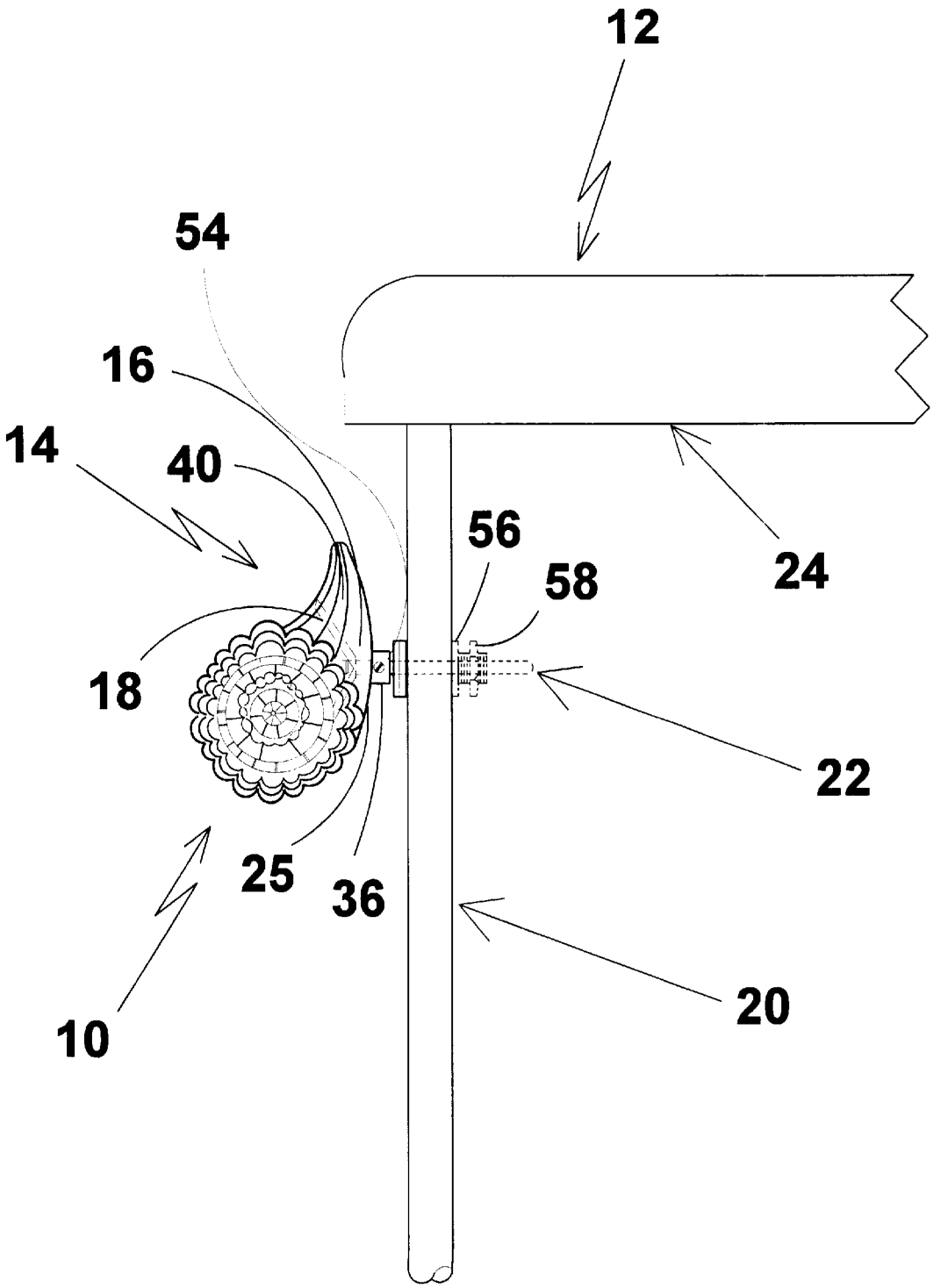
FIG. 2 is cutaway illustration of the present invention in use, shown is a partial side view of the typical toilet having the manufacturers handle removed and a threaded shaft having two rotatively mounted members. The selected ornamental decorative article has a hollow interior. The first rotative member having hingedly attached divergent arm members is inserted into said cavity whereupon the divergent arm members are used in conjunction with the second member rotative disc to frictionally engage the wall of the ornamental decorative article.

Turning to FIG. 2, shown therein is a cutaway illustration of the present invention 14 in use, shown is a partial side view of the typical toilet 12 having the manufacture's handle removed and a threaded shaft 16 having thereon two rotatively mounted members 18. The selected ornamental decorative article 10 has a hollow interior 40. The first rotative member 18 having hingedly attached divergent arm members 30 is inserted into the cavity 40 whereupon the divergent arm members 30 are used in conjunction with the second member rotative disc 36 to frictionally engage the wall 25 of the ornamental decorative article 10. Also shown is the toilet tank wall 20, the lift arm 22, and the toilet tank cover 24.

Turning to FIG. 3, shown therein is an exploded view of the ornamental toilet flush handle 10 as shown in FIG. 2. The present invention 14 is comprised of a threaded shaft 16 having two members mounted thereon. The first member 18 has a collar 26 with a centrally positioned threaded aperture 28 (not visible) for selectively positioning the first member 18 on the threaded shaft 16. The collar 26 has two oppositely positioned springs 27 attached to the exterior surface of the collar 26 having each leg member 30 fixedly positioned to divergent arm members 30. The arm members 30 have threads 32 on their external surfaces so that the divergent arms 30 can be pressed to the body of the threaded shaft 16 whereby the divergent arms 30 will permit the device to be used in much the same fashion as a screw. Conventional mounting hardware 54 is also shown, along with fastener 56 and nut 58.

As illustrated the decorative item 10 has no interior structure. The present invention 14 mounting hardware device having a first rotative member 18 having divergent arm members 30 which can be inserted into a user supplied aperture 34 whereupon the divergent arm members 30 will flair out once inside the decorative object 10 similar to a conventional molly bolt. The second mounted member is a disc 36 having a centrally positioned threaded aperture 38 therethrough. The second mounted member 36 can be advanced toward the arms 30 of the first mounted member 18 until the wall 25 of the ornamentally decorative item 10 is fixedly secured between the two mounted members 18, 36 whereby it is secured by locking set screw 60 in the conventional manner. Lift arm 22 is also shown along with other conventional mounting hardware 54 including a threaded fastener 56 and nut 58.

Turning to FIG. 3A, therein is shown is an illustrative view of the ornamental decorative article 10 which will be used instead of the manufactures toilet flush handle having a user supplied access aperture 34 therein. Also shown is the central shaft member 16 having the first rotative member 18 mounted thereon. The divergent hingedly attached arms 30 can be compressed to insert the threadably mounted first member 18 into the ornamentally decorative articles 10 cavity 40 whereby the first members 18 divergent arms 30 will extend to a fully open at rest position. Collar 26 and spring 27 are also shown whereby springs 27 oppositely urge arms 30 away from each other.

Turning to FIG. 4, shown therein is a continued illustrative view of the method and device for mounting the ornamentally decorative seashell 10 onto the present invention 14 mounting hardware whereby the ornamentally decorative seashell 10 can be used in place of the manufactures supplied flush handle.

Once the first rotative member 18 having divergent arm members 30 thereon is positioned within the cavity 40 of the decorative article 10 having the arm 30 in a fully extended at rest position, then the second mounted member 36 can be advanced toward the first mounted member 18 until the decorative item 10 is fixedly contained between the two mounted members 18, 36. The decorative object 10 can be further fixedly attached by applying an amount of adhesive 50 (not visible) to the contact points between the first and second mounting members 18, 36 and the decorative figurine 10 or by injecting an expandable foam material 52 (not shown) which will provide rigidity for the hollow core 40 of the decorative article 10.

Turning to FIG. 5, shown therein is a continued illustrative view of the method and device for mounting the ornamentally decorative seashell 10 onto the present invention 14 mounting hardware whereby the ornamentally decorative seashell 10 can be used in place of the manufactures supplied flush handle.

Shown is the decorative handle 10 installed in place of the manufacturer's handle. The means for securing the seashell using the threadably mounted first 18 and second 36 member can additionally be enhanced by the selective application of adhesive as previously disclosed. The lift arm 22 is also shown.

Turning to FIG. 6, shown therein is an illustration of an ornamental article 10 affixed to the toilet flush handle. The mounting hardware device is comprised of a threaded shaft 16 having two members mounted thereon. The first member 18 has a collar (not shown) with a centrally positioned threaded aperture for selectively positioning the first member 18 on the threaded shaft 16. The collar has two oppositely positioned springs attached to the exterior surface of the collar having each leg member fixedly positioned to divergent arm members 30. The arm members have threads 32 on their external surfaces so that the divergent arms 30 can be pressed to the body of the threaded shaft 16 whereby the divergent arms 30 will permit the device to be used in much the same fashion as a screw. This will enable the fastener to be threaded into a user-supplied aperture within the chosen decorative object 10. Further the decorative object 10 can be fixedly attached to the device by applying an amount of adhesive on the divergent arms prior to mounting the decorative object 10 thereon.

Turning to FIG. 7, shown therein is an additional illustration of an ornamental article 10 affixed to the toilet as the flush handle similar to FIG. 6.

What is claimed to be new and desired to be protected by Letters Patent is set forth in the appended claims.

I claim:

1. An apparatus for a decorative flush handle for mounting on a mechanism of a conventional toilet bowl handle, comprising:

a) an elongated threaded member;

b) means for connecting said elongated threaded member to the mechanism of a conventional toilet bowl handle;

c) a rotatable member having a collar thereon, said collar having a threaded aperture therein, said aperture for receiving said elongated threaded member, said rotatable member being mounted onto said elongated threaded member, said rotatable member being positionally adjustable by rotation on said elongated threaded member;

d) a decorative item having a cavity therein for receiving said rotatable member therein;

e) a pair of oppositely opposing arms mounted onto said rotatable member, said pair of arms being hinged;

f) means for urging said pair of oppositely opposing arms away from each other; and, g) means for securing said rotatable member to said decorative item whereby a wall of said decorative item is securable between said rotatable member and said means for securing.

2. The apparatus of claim 1, said means for urging said pair of oppositely opposing arms away from each other further comprising a spring means.

3. The apparatus of claim 2, said spring means further comprising at least one spring.

4. The apparatus of claim 1, said pair of oppositely opposing arms further comprise threads on the outer surface thereof, said threads being complementary to said threads on said elongated threaded member, said elongated threaded member being threadable into the body of said decorative item.

5. The apparatus of claim 1, said means for securing said rotatable member to said decorative item further comprising a disc having a centrally threaded aperture therein for receiving said elongated threaded member, said disc being positionally adjustable by rotation on said elongated threaded member.

6. The apparatus of claim 5, wherein said disc by being adjustably positioned on said elongated member secures the wall of said decorative item between said disc and said rotatable member.

7. A method for a decorative flush handle for mounting on a mechanism of a conventional toilet bowl handle, comprising the steps of:

a) providing an elongated threaded member;

b) connecting said elongated threaded member to the conventional toilet bowl handle;

c) providing a first rotatable member having a collar thereon having a threaded aperture therein for receiving said elongated threaded member and then mounting said first rotatable member onto said elongated threaded member;

d) providing a decorative item having a cavity therein for receiving said first rotatable member therein;

e) mounting a pair of oppositely opposing, hinged arms onto said first rotatable member;

f) urging said pair of oppositely opposing arms away from each other; and, g) adjustably positioning a second rotatable member on said elongated threaded member for securing the wall of said decorative item between said first rotatable member and said second rotatable member.

8. The method of claim 7, further comprising the step of threading the outer surface of said pair of oppositely opposing arms, said threads being complementary to said threads on said elongated threaded member, whereby the elongated threaded member is threadable into the body of said decorative item.

9. The method of claim 7, further comprising the step of using a spring for urging said pair of oppositely opposing arms away from each other.

10. The method of claim 9, further comprising the step of using a pair of springs.

11. The method of claim 9, further comprising the step of using a spring.

12. The method of claim 7, further comprising the step of using a disc for the second rotatable member said disc being positionally adjustable by rotation on said elongated threaded member.

* * * * *